US006802485B1

(12) United States Patent
Cassidy

(10) Patent No.: US 6,802,485 B1
(45) Date of Patent: Oct. 12, 2004

(54) TWO-PIECE MUSIC STAND ACCESSORY FOR LARGE BOOKS

(76) Inventor: Terrence A. Cassidy, 4 Tanglewood Cir., Reading, MA (US) 01867

( * ) Notice: Subject to any disclaimer, the term of this patent is extended or adjusted under 35 U.S.C. 154(b) by 0 days.

(21) Appl. No.: 10/385,347

(22) Filed: Mar. 10, 2003

(51) Int. Cl.[7] ..... A47B 19/00

(52) U.S. Cl. ..... 248/441.1; 248/443; 248/448; 248/460; 211/135; 84/453; 84/472

(58) Field of Search ..... 248/441.1, 443, 248/448, 445, 447.2, 449, 451, 459, 460; 84/453, 385 A, 472; 297/135; 312/233; 108/65, 69; 211/119.003, 135

(56) References Cited

U.S. PATENT DOCUMENTS

| | | | | | |
|---|---|---|---|---|---|
| 511,586 | A | | 12/1893 | Carter | |
| 513,113 | A | | 1/1894 | Kelly | |
| 1,037,233 | A | * | 9/1912 | Furrow | 248/448 |
| 1,069,617 | A | | 8/1913 | Ilvonen | |
| 1,117,386 | A | * | 11/1914 | Hughes | 248/446 |
| 1,359,811 | A | * | 11/1920 | Wood et al. | 248/462 |
| 1,476,838 | A | * | 12/1923 | Pratt | 248/441.1 |
| 1,818,717 | A | * | 8/1931 | Kliegl | 248/448 |
| 2,156,489 | A | | 5/1939 | Bonetti | |
| 4,300,743 | A | | 11/1981 | Morris | |
| 4,312,490 | A | * | 1/1982 | Biasini | 248/542 |
| 4,372,518 | A | * | 2/1983 | Biasini | 248/441.1 |
| 4,448,384 | A | | 5/1984 | Jones, Jr. et al. | |
| 4,488,469 | A | * | 12/1984 | Demello et al. | 84/385 A |
| 4,501,403 | A | * | 2/1985 | Goodrich | 248/443 |
| 4,569,498 | A | * | 2/1986 | Ermanski | 248/441.1 |
| 6,293,511 | B1 | * | 9/2001 | Shepherd | 248/441.1 |

* cited by examiner

*Primary Examiner*—Kimberly Wood

(57) ABSTRACT

A two-piece music stand accessory for holding large music volumes consisting of a pair of cleats (11) with a lengthwise slot (14) to allow mounting on the existing ledge of a music stand. An alignment pin (13) joins them in the center, providing support and rigidity for the assembly when the cleats are slid together. Once the pin is disengaged, the cleats can remain on the stand's ledge and yet permit folding. One or more bow hooks are fitted through the front edge of the cleats to accommodate a fiddler's bow. A lip (17) on the front edge of the cleats assists in holding open book pages.

1 Claim, 3 Drawing Sheets

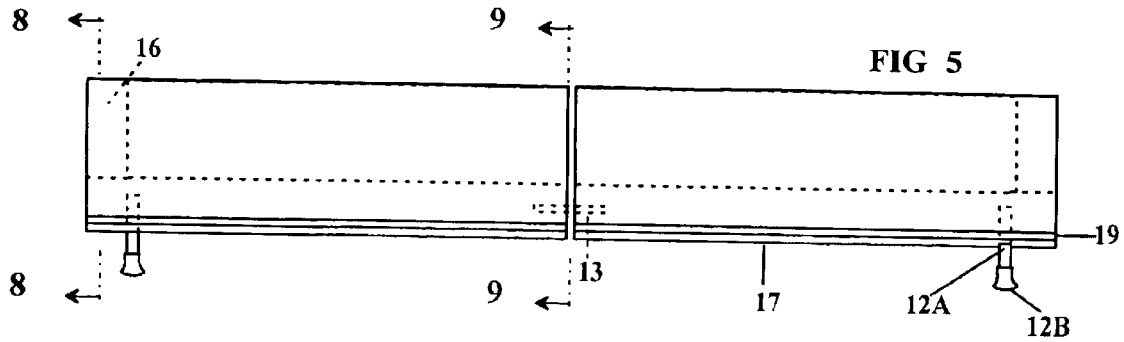
FIG 5
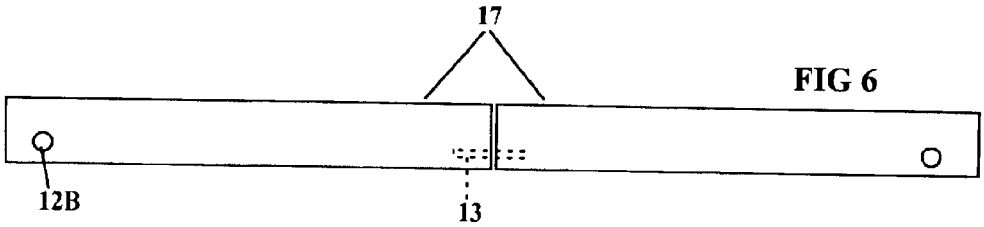
FIG 6
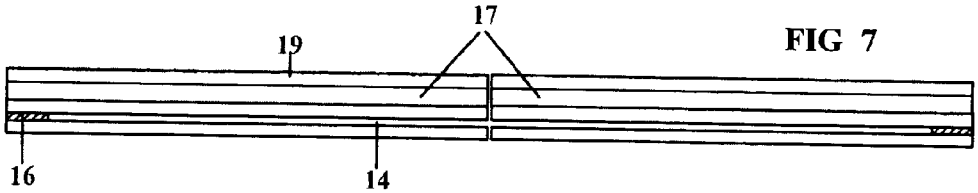
FIG 7
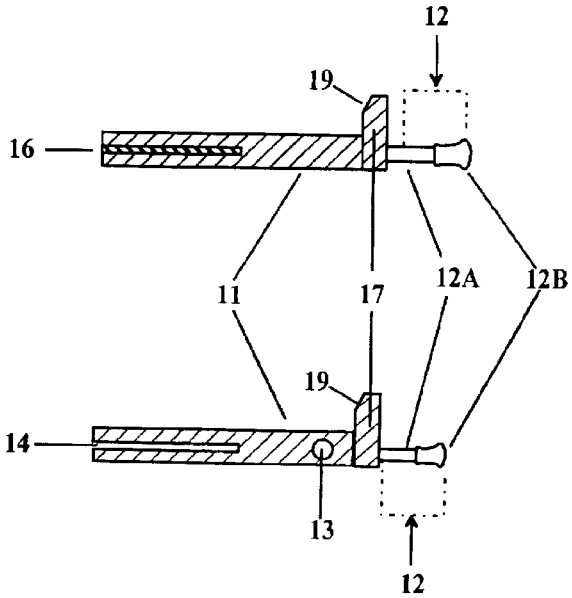
FIG 8
FIG 9

TWO-PIECE MUSIC STAND ACCESSORY FOR LARGE BOOKS

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to music stand accessories, specifically to enhancing the capacity and usefulness of the portable folding stands for holding volumes of music that are normally too large for these stands to accommodate.

2. Background of the Invention

Most music stands, especially the folding portable type, have an oblique music support ledge which is far too narrow to support all but the thinnest volumes of music. These stands also lack a means of holding open the pages of music books. In addition, fiddlers need a place to rest the bow, and often engage in the unsafe practice of hanging it off the back of the stand where it is prone to being dislodged when adjusting the position of the music on the ledge. It is believed that currently, no such dedicated bow-hook or holder exists.

Clearly, many musicians have a need for a device that will enhance the capabilities of the average music stand in a way that will provide them with both increased capacity and improved access to their music. Especially by providing fiddlers with a handy and secure "third hand" when turning pages, etc.

Heretofore, such accessories have focused on everything but the music. From cup holders (Manhasset mnf.) to Electric Light fixtures such as U.S. Pat. No. 5,131,13 to Kelly (1984). The problem of holding music has usually been addressed by increasing the size and weight (not to mention the cost) of the stand as in U.S. Pat. No. 1,069,617 to Ilvonen and U.S. Pat. No. 2,156,489 to Bonetti. Or by focusing on very complex mechanical methods for engaging and turning the pages (U.S. Pat. No. 4,448,384 to Jones, 1984). U.S. Pat. No. 4,300,743 to Morris (1981) provides a detachable tray with a music shelf, but again its main focus is on accommodating musical accessories rather than the music per se. Furthermore it cannot be left on the stand to aid portability since it is not detachable or foldable in the middle. Likewise, it does not provide a lip or other means of restraint to assist in holding open the pages of bound volumes. Nor does it provide a place for a fiddler to safely hang the bow.

SUMMARY OF THE INVENTION

The present invention fulfills the above-mentioned need by providing a rectangular pair of cleats specially designed to snugly fit over the existing front ledge of the conventional music stand to increase both its length and width. A short pin of predetermined diameter and length protruding from the inner side of one cleat engages a matching recess in the corresponding location of the other cleat, allowing the two halves to be temporarily joined together. This assures proper alignment of the two cleats and results in a rigid, stable assembly. Portability is maintained by the two-piece design, which enables the user to leave them partially attached to the stand even when folded once the pin is disengaged from the recess.

In addition, the preferred embodiment provides a front lip running the full length of the cleats, which acts as a stop to hold open the pages of bound volumes. The design is inherently reversible, and the whole arrangement can be flipped upside down and replaced on the stand with the front lip hanging below the ledge should a musician want to temporarily disable this feature.

One or a plurality of soft-tipped pegs, protruding from the front edge of the cleats, provide plenty of flexibility for hanging a fiddler's bow. In the preferred embodiment, they are removable should the musician have no need of them.

BRIEF DESCRIPTION OF THE DRAWINGS

The two related drawings

FIG. 1 shows the preferred embodiment with a chamfered lip attached to the front edge of the supports.

FIG. 2 shows the device being assembled onto the front ledge of the music stand.

FIG. 5 shows a plan view of the preferred embodiment

FIG. 6 shows the front view of the same embodiment

FIG. 7 shows the rear view, with the exposed slot

FIGS. 8 and 9 are sectional views 8—8 and 9—9 respectively, from FIG. 5 as shown

Figure 1:
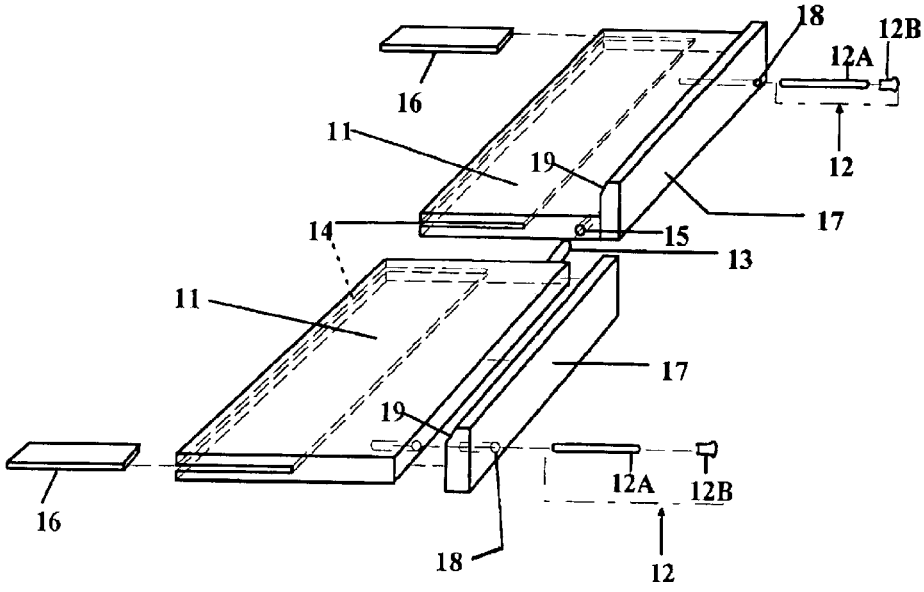
FIG. 1 and FIG. 2 show the two embodiments of the invention.

| DRAWINGS-Reference Numerals | |
|---|---|
| 11. Cleat | 16. End Plug |
| 12. Bow Hook | 17. Lip |
| 12A: Bow Hook body | 18. Bow Hook hole |
| 12B: Soft Protective Tip | 19 Chamfer |
| 13. Alignment Pin | 20 Music Stand (folding) |
| 14. Slot | 21 Fiddler's bow |
| 15. Alignment pin Hole | 22. Music Stand Ledge |

DETAILED DESCRIPTION

FIG. 1. Preferred Embodiment

A preferred embodiment of the stand accessory is shown in FIG. 1. This perspective view shows that the accessory consists of a pair of rectangular cleats 11 with a short lip 17 running the full length of the front face of each cleat. The inner top edge of the lip is beveled along the full length, substantially at a 45-degree angle to ease the turning of music pages (19).

Each cleat incorporates a slot 14, running the center length of the back faces, and stopped at the extremities with end plugs 16. The slot enables each cleat to reversibly engage the existing music support ledge 22. Typically this slot is around ⅙" to ⅛" wide depend on the exact style of stand it is designed for. It is deep enough (typically about 1½ inches) to fully engage the music stand ledge 22. For ease of manufacturing, the slot is machined or otherwise formed along the full length of the cleat. A rectangular end plug, dimensioned to the identical thickness and depth of the slot, is then used to permanently close the outer extremity of each slot. Typically, this plug is around ¾" to 1" the width, and long enough to fully reach the bottom of the slot 14. It is permanently glued or cemented in place. Afterwards, any excess material can be trimmed or sanded off, rendering the end plug perfectly flush with the back and outer side of the cleat. The finished plugs lend strength to the accessory by preventing the tendency of the slot(s) 14 to spread open in use. Appearance is enhanced as well.

A bow hook 12 is provided on the lower front edge of the lip, hook consisting of all diameter (typically 11/64") peg 12A that is inserted into a matching hole drilled through the front of the lip and into the cleat behind to a depth of about 1". The fit of the hook in the hole is substantially snug, but the hook is not glued or otherwise permanently fixed so as to permit removal if desired. The exposed end of the hook is capped with a soft protective tip 12B of rubber or plastic to prevent damage to the bow or instrument.

An alignment pin 13 is permanently attached to one of the cleats so as to protrude from the inner side. The protruding pin engages a correspondingly located and sized hole 15 in the other cleat, providing means for aligning and joining the two halves of the accessory together when placed over the ledge of the music stand. The alignment pin also provides extra rigidity for the front of the accessory, reducing the tendency of the ledge to flex under the weight of large volumes. Once mounted on the stand, the two halves need only to be slid apart enough to disengage the pin (typically an inch or so) to enable the stand to fold without fully removing the accessory.

Figure 4:
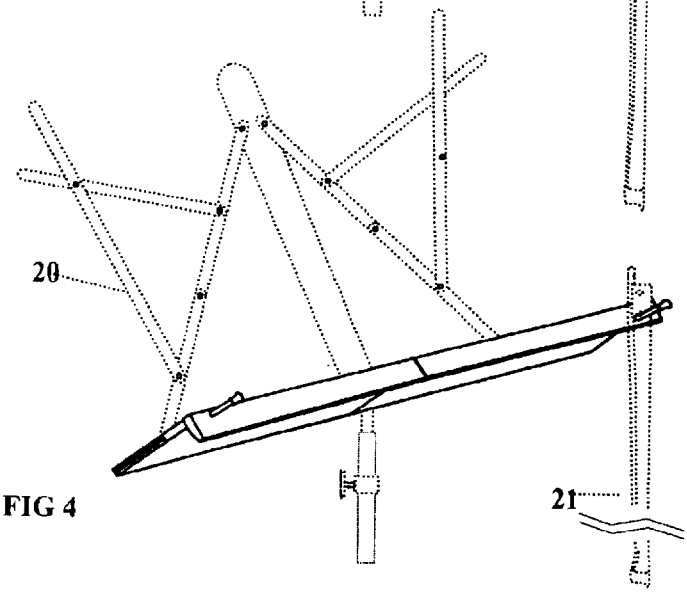
FIG. 4 shows the same embodiment but reversed so that the lips are now downward, and out of the way. The musician's bow can still be accommodated as in FIG. 3.

Since the accessory is symmetrical, it can be flipped upside down and mounted with the lip pointing downward. This is an advantage for users who at times may not need or want the lip present to restrain music pages as shown in FIG. 4.

Figure 1A:
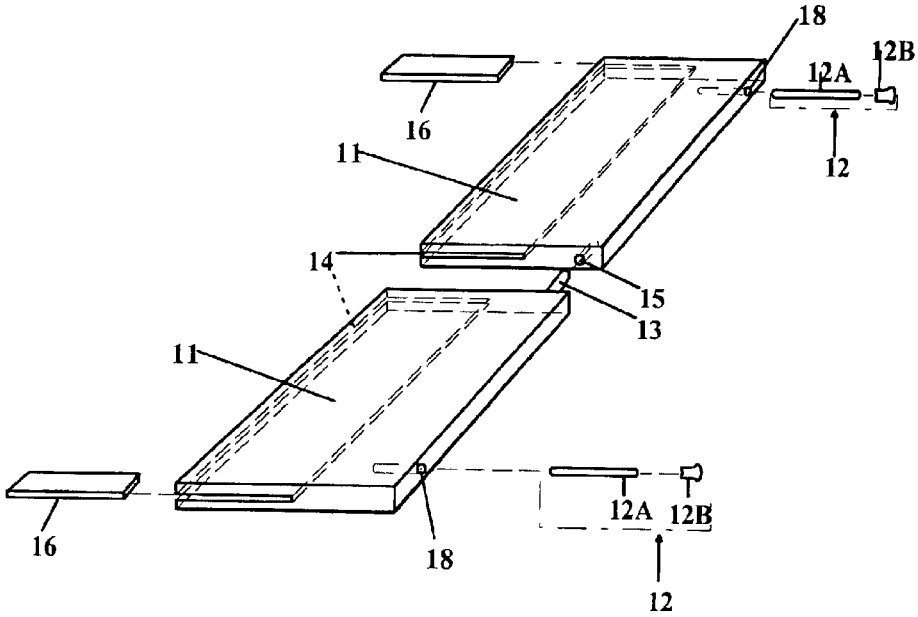
FIG. 1A shows the same aspect but without the lip.

FIG. 1A—Alternate Embodiment

The embodiment shown in FIG. 1A illustrates the accessory minus the lip. This would result in a cheaper version of the accessory, while still providing the valuable feature of the bow hooks. Overall usable area would remain the same, as would the means of attachment to the stand.

Figure 2:
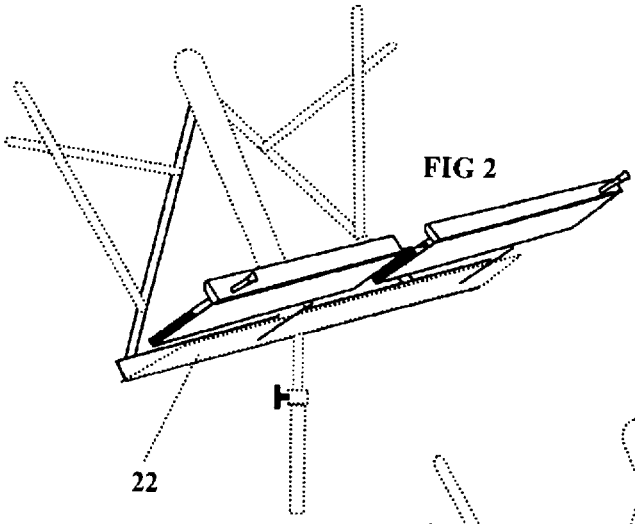
Figure 3:
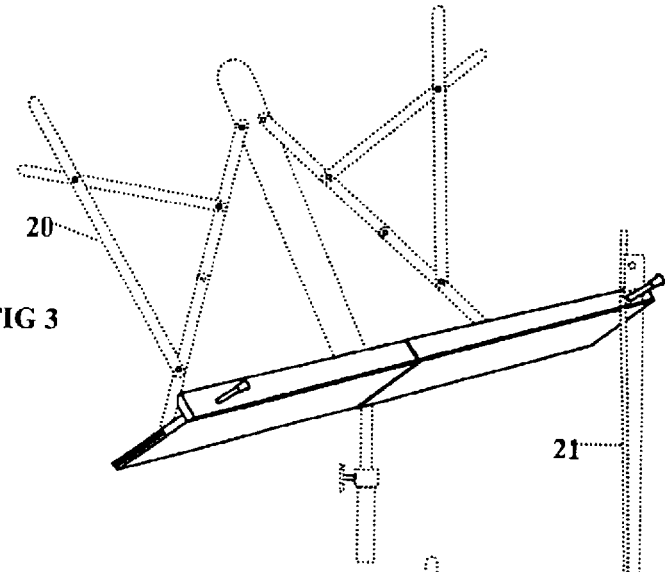
FIG. 3 shows the relationship of the preferred embodiment to a typical fold-up music stand with the front lips deployed upright and a musician's bow in place on the bow-hook.

Deployment and use: FIGS. 2, 3, 4

The manner of attachment to the stand, as shown in FIG. 2, involves alignment of the rear slots 14 in the back of the cleats 11 with the music stand's ledge 22, while making sure the end plugs 16 clear the extremities of the ledge; then fully sliding each cleat back as far as they will go on the ledge. The two cleats are then joined by sliding them together, making sure that the alignment pin 13 fully engages the matching hole 15. To refold the stand, the cleats need only be slid apart about an inch, or until the pin disengages the hole. This will allow the top portion of the stand to fold without completely disengaging the cleats from the stand's ledge. Clearly this ability represents an improvement from existing accessories that are not foldable or detachable lengthwise and hence need to be completely separated from the stand for transport. In use, the lip 17 restrains the tendency of the pages of bound volumes to turn, and acts as a guard against accidentally dislodging the book(s) or any other accessories the user has placed on the cleats. A machined chamfer 19 on the inner edge of the lip eases the turning of pages by the user while still enabling the volume to be stopped open.

Yet, if the user wants the cleats out of the way for any reason, the symmetrical nature of the design allows the accessory to be removed and rotated 180, then being reinstalled "upside down" on the music stand ledge as shown in FIG. 4. The simplicity and utility of this design offer a distinct improvement over other complex and expensive page-holding designs (See U.S. Pat. No. 4,448,384 to Jones et al. 1984.) Also, the bow-hook 12 is believed to be the first implementation of its kind for specifically accommodating a violinist/fiddler or viola player's bow. Typically, the bow is hung from the bow-hook by it's frog, or base as shown in FIGS. 3, 4, thereby providing a safe and practical location for temporarily retaining the bow while the user manipulates other accessories, turns pages, etc. Up until now, the only recourse the fiddler had was to suspend the bow from one of the folding arms of the stand above the ledge, where it was awkwardly located, and prone to being dislodged by the music which invariably came into contact with it.

The simple shape of the cleats allows for mass production via the extrusion process, whereby a thermosetting polymer is forced through a die of the required cross section to produce blanks which are then cut to length, holes 15, 18 drilled and the end plugs 16 inserted and heat fused or glued. The alignment pin 13, and bow hook(s) 12 are then assembled in their respective holes.

The reader can see therefore, that the accessory of the invention provides a simple and straightforward method for enhancing the capacity of the average music stand; that it can be folded in such a manner as to maintain portability, and that it can be manufactured in a variety of materials and methods, including but not limited to: Plastic, wood, metal and composites thereof.

Thus the scope of the invention should be determined by the appended claims and their legal equivalent, rather than by the examples given.

I claim:

1. A sheet music stand accessory in combination with a folding portable sheet music stand having a generally upright rear sheet music support member with a forward projecting sheet music support ledge, said stand accessory comprising:

a rectangular platform of predetermined length, width and thickness which substantially increases the usable size of said music stand support ledge;

a front face of said platform incorporating a longitudinal slot engaging said sheet music support ledge;

said platform comprising two substantially equal and symmetrical cleats;

each said cleat having a lip of predetermined height and thickness permanently attached to a back face of said cleat and substantially at a right angle to a top face of said cleat and running the full length of said back face;

each said lip incorporating a small bevel or chamfer of about 45 degrees on a top inner edge of the lip to ease the turning a book page;

a means for joining said cleats together end to end on said music stand being a pin engaged in an opening in a side face of each said cleat;

wherein said cleats are capable of remaining attached to said music stand when folded provided said cleats are disengaged from each other;

said cleats allowing 180 degree reversibility in that said cleats can be positioned upside-down on said music stand ledge, thereby having said lips extending downward and out of the way of a user;

each of said cleats incorporating a permanently fixed end cap in an outer extremity of said slots;

a removable bow-hook on a front face of each said lips allowing the user to hang a bow vertically from the accessory.

* * * * *